US009617822B2

(12) United States Patent
O'Connor et al.

(10) Patent No.: US 9,617,822 B2
(45) Date of Patent: Apr. 11, 2017

(54) COMPLIANT SEAL FOR IRREGULAR CASING

(71) Applicant: Baker Hughes Incorporated, Houston, TX (US)

(72) Inventors: Keven O'Connor, Houston, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 544 days.

(21) Appl. No.: 14/095,315

(22) Filed: Dec. 3, 2013

(65) Prior Publication Data

US 2015/0152707 A1 Jun. 4, 2015

(51) Int. Cl.
*E21B 33/128* (2006.01)
*E21B 33/12* (2006.01)

(52) U.S. Cl.
CPC ..... *E21B 33/1285* (2013.01); *E21B 33/12* (2013.01); *E21B 33/1208* (2013.01)

(58) Field of Classification Search
None
See application file for complete search history.

(56) References Cited

U.S. PATENT DOCUMENTS 4,354,554 A * 10/1982 Calhoun ..... E21B 33/12 166/105.5
4,586,720 A 5/1986 Simmons et al.
4,673,026 A 6/1987 Hagar et al.
4,729,569 A 3/1988 Muller et al.
5,277,253 A 1/1994 Giroux et al.
5,810,082 A 9/1998 Jordan
5,826,652 A 10/1998 Tapp
6,267,381 B1 7/2001 Wright
7,080,685 B2 7/2006 Bailey et al.
7,367,404 B2 5/2008 Simpson et al.
8,453,729 B2 6/2013 Harris et al.
2005/0205269 A1 9/2005 Kilgore et al.
2008/0023193 A1 1/2008 O'Brien
(Continued)

FOREIGN PATENT DOCUMENTS

GB 474499 A 11/1937
GB 2119452 A 11/1983

OTHER PUBLICATIONS

Well Seals, LLC, www.wellseals.net/serving.html; 1 page.

*Primary Examiner* — Jennifer H Gay
*Assistant Examiner* — Caroline Butcher
(74) *Attorney, Agent, or Firm* — Steve Rosenblatt

(57) ABSTRACT

A setting assembly for a packer seal features peripherally mounted rod pistons that abut the seal to be set by advancing the seal relative to a tapered surface. When parts of the seal engage an inner tubular wall before other parts of the seal the continuation of application of hydraulic pressure to the pistons moves parts of the seal that have yet to make contact with the tubular wall further relative to the ramp so that plastic deformation of the seal assembly can occur to allow portions thereof to move radially further outwardly to seal in the region where the radius of the tubular is enlarged. When hydraulic pressure is applied to the pistons in an opposite direction a lock mechanism is defeated and the c-ring or scroll reverts to a smaller shape optionally aided by a garter spring so that the packer can be selectively retrieved.

21 Claims, 7 Drawing Sheets

(56) References Cited

U.S. PATENT DOCUMENTS

| | | | |
|---|---|---|---|
| 2009/0146419 | A1 | 6/2009 | Gustafsson |
| 2010/0326675 | A1 | 12/2010 | Doane et al. |
| 2012/0024542 | A1 | 2/2012 | Keat et al. |
| 2012/0112102 | A1 | 5/2012 | Stadler et al. |
| 2012/0205872 | A1 | 8/2012 | Reinhardt et al. |

* cited by examiner

COMPLIANT SEAL FOR IRREGULAR CASING

FIELD OF THE INVENTION

The field of this invention relates to packer seals and more particularly to seals that are subject to continuing axial force to move portions of a seal that are at a more distant portion of an out of round inner tubular wall to be reached by the seal for sealing contact.

BACKGROUND OF THE INVENTION

Various packer seal designs have been tried to address potential leakage issues if the tubular interior wall is out of round. Large rubber rings with soft backups have been tried in the Premier packer line offered by Baker Hughes Incorporated. Another style that has an ability to compensate for out of roundness is an inflatable packer design although such designs are typically used in low pressure differential applications. Swelling packers can also take the irregular shape of the inside wall of a surrounding tubular but are generally felt as being more limited in the ability to withstand large pressure differentials. The ZXP line of packers from Baker Hughes Incorporated compensate for tubular out of roundness with very high setting forces so that the seal on the tight portions of the tubular with the intentions that portions of the seal will migrate to the looser portions of tubular where the radius has enlarged. This design has high pressure differential capability but the high setting force also presents a risk to the casing itself such as undue localized stress that can result in propagating a wall crack and potential tubular leakage.

What is needed and provided by the present invention is a compliant seal design and an associated seal setting system. The setting mechanism comprises a plurality of pistons about the packer mandrel at the outer periphery so that common applied hydraulic pressure advances all the pistons and selectively locks their movement for the set with a ratchet mechanism. Some of the pistons closest to where the tubular radius is greater then continue to apply force and axially displace portions of the seal assembly on an inclined surface for preferably plastic deformation in the axial direction that results in further radial extension so that the seal assembly seals all the way around in even significantly out of round tubulars. The pistons can be actuated to retract to overcome a locking effect from a ratchet lock ring and the seal assembly can be a simple rubber element with molded garter springs in place to assist in retraction or in the shape of a metal c-ring or scroll so that alone or in combination with a potential energy device such as a garter spring will pull the seal assembly to a smaller dimension for retrieval. The seal assembly is preferably a metallic housing with spaced flanges defining a groove in between where the seal material is disposed. A retrievable version of the seal assembly may or may not consist of a metallic housing. Minimizing the length of the seal assembly while providing backup to the seal element in both directions allows for use of reduced force to create the needed deformation for sealing in out of round tubulars. These and other features of the present invention will be more readily apparent to those skilled in the art from a review of the description of the preferred embodiment and the associated drawings while recognizing that the full scope of the invention is to be determined by the appended claims.

SUMMARY OF THE INVENTION

A setting assembly for a packer seal features a series of peripherally mounted rod pistons that actuate the seal to be set by advancing the seal relative to a tapered surface. When parts of the seal engage an inner tubular wall before other parts of the seal the continuation of application of hydraulic pressure to the pistons moves parts of the seal that have yet to make contact with the tubular wall further relative to the ramp so that plastic deformation of the seal assembly can occur to allow portions thereof to move radially further outwardly to seal in the region where the radius of the tubular is enlarged. When hydraulic pressure is applied to the pistons in an opposite direction a lock mechanism is defeated and the retrievable seal element (rubber element or metal helix) reverts to a smaller shape optionally aided by a garter spring so that the packer can be selectively retrieved.

DETAILED DESCRIPTION OF THE PREFERRED EMBODIMENT

Figure 4:
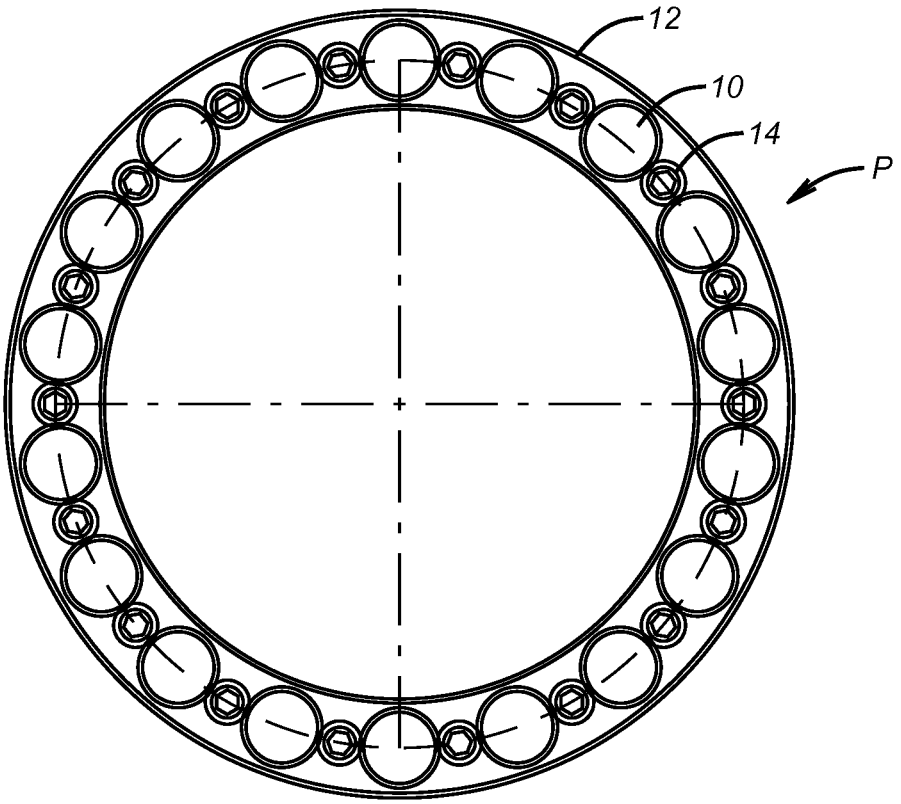
FIG. 4 is a section view through line 4-4 of FIG. 1*a;*
Figure 5:
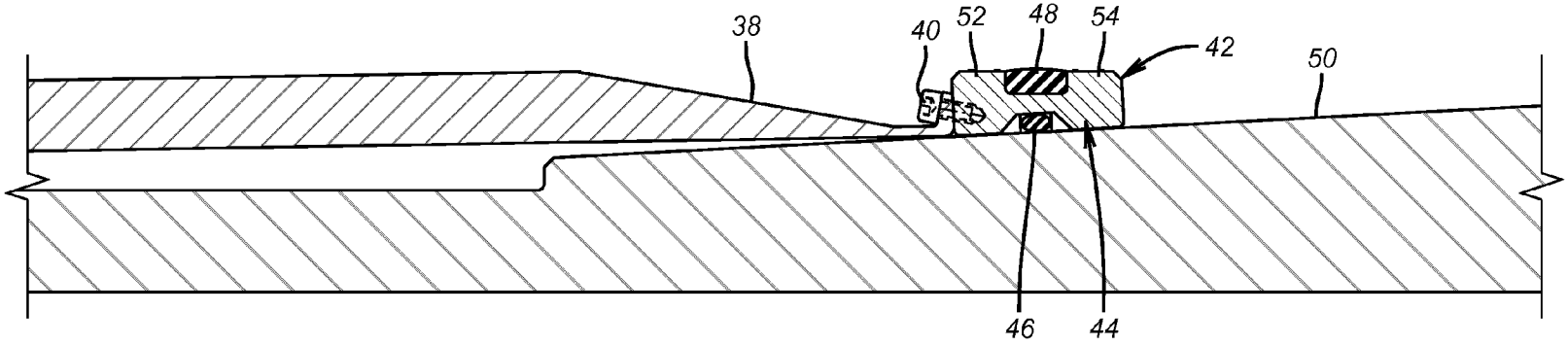
FIG. 5 is a section view showing the connection of the piston to the seal assembly.

FIG. 4 shows 20 evenly spaced piston bores 10 in the mandrel 12 for packer P. The smaller holes 14 are for bolts to hold mandrel components together so that each of the piston bores 16 can be defined. The piston assembly 18 has a top end 20 with a seal 22. A plug 24 has a through passage 26 and a seal 28. A snap ring 30 is used as a travel stop for the plug 24 and ring 32 holds the plug 24 to the mandrel 12. The piston assembly 18 has an optional pinned connection 34 shown in elevation view in FIG. 1*a* and in plan in FIG. 1*b*. A lower section 36 of the piston assembly 18 has a lower end taper 38 that enables a fastener 40 to be secured to the seal assembly 42. The seal assembly 42 is made from metal in the form of an I-beam 44 when viewed in section. An inside seal 46 prevents leakage along the ramp surface 50. The main seal for the surrounding out of round tubular is 48. The shape of 44 provides opposed flanges 52 and 54 that flank the main seal 48. Item 44 can be 8620 annealed steel or stainless 316 or hastelloy depending on the service conditions. The seal 48 can be rubber, AFLAS or some high temperature compatible material with the well fluids that are expected.

Figure 1A:
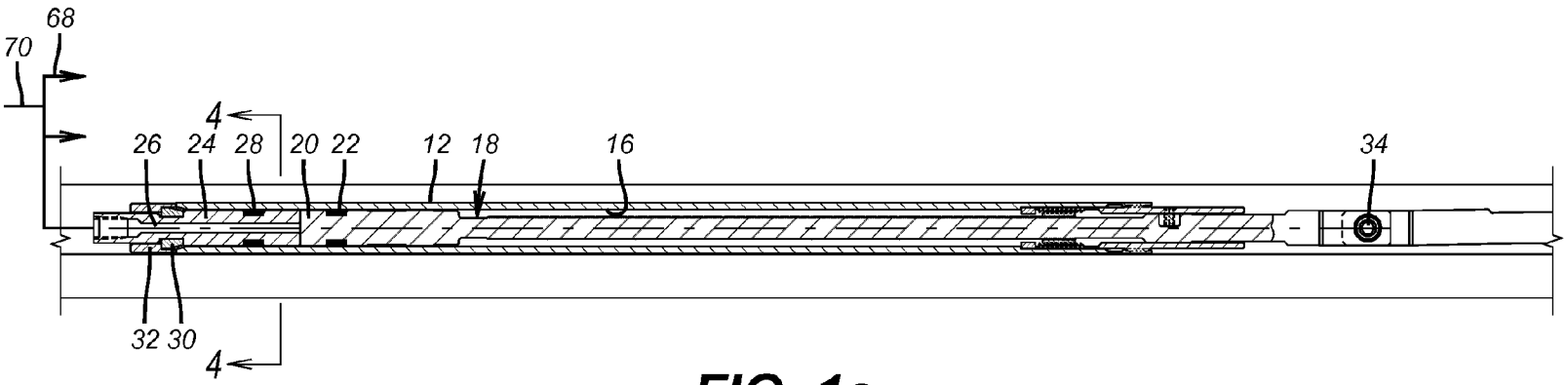
FIGS. 1*a* and 2 are a section view of the piston assembly within the piston bore and a plan view of the extending portion of one of several pistons.
Figure 1B:
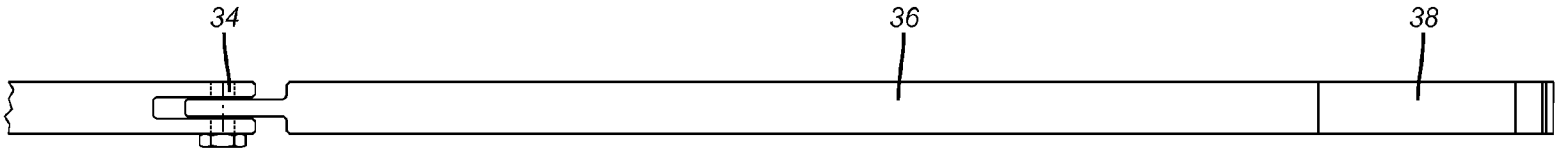
FIG. 1*b* is an elevation view of the extending portion of a piston of FIG. 1*b;*
Figure 2:
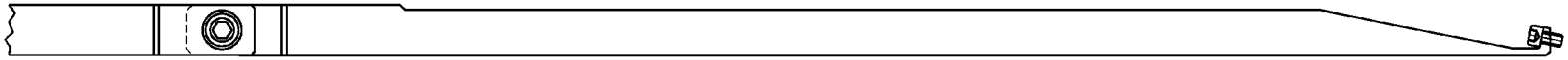
Figure 6:
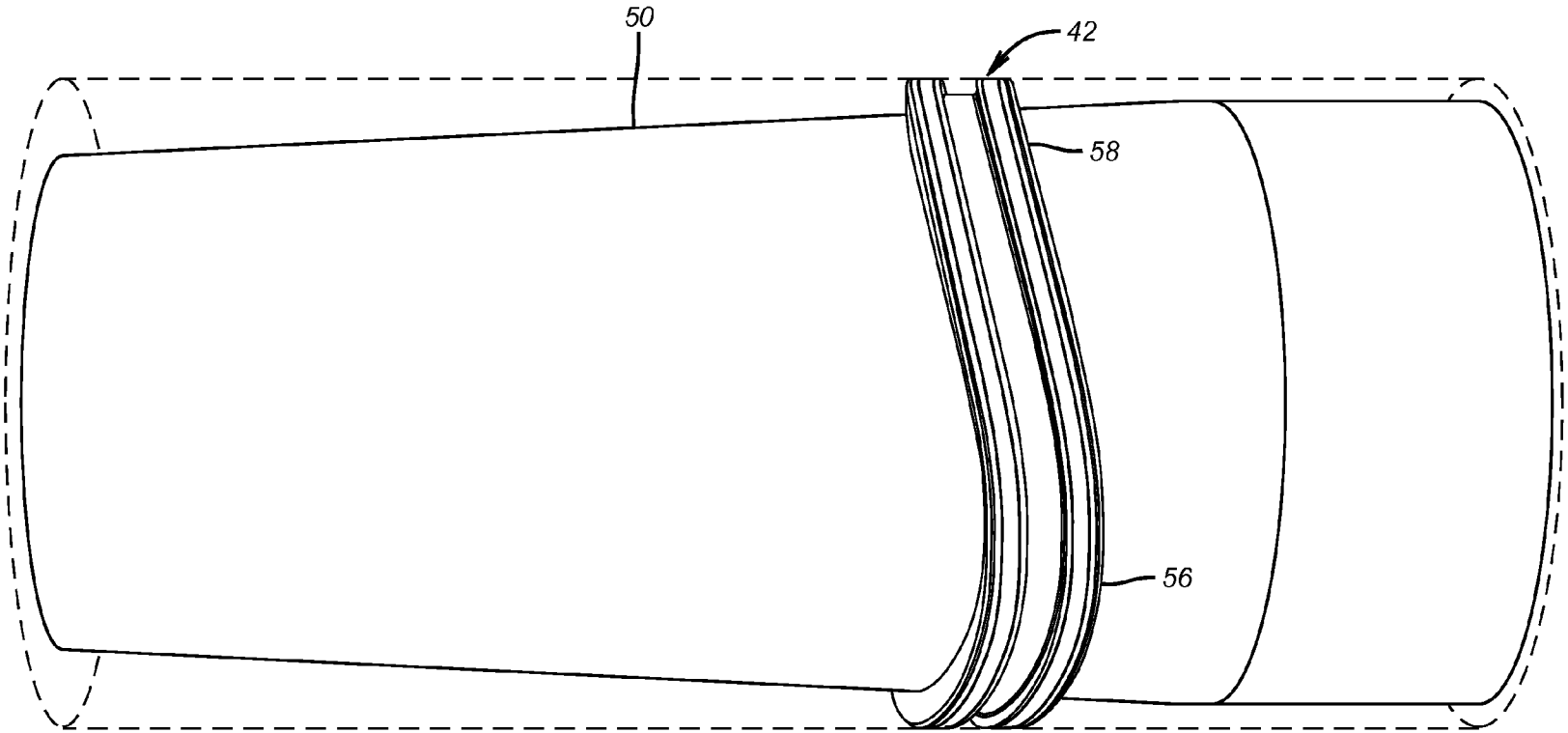
FIG. 6 is a representation of the set shape of the seal assembly after unequal piston movement that moves part of the seal further up a ramp than other parts of the seal.

FIG. 6 shows the uneven movement of the seal assembly 42 relative to the ramp surface 50 in the axial direction when looking circumferentially about the seal assembly 42. Portions 56 extend out radially further than portions 58 that have not been pushed as far up the ramp surface 50. Looking at FIG. 3 it can be seen that movement of the piston assembly 18 in the direction of arrow 60 drags ring 62 along ratchet pattern 64 for unidirectional movement with teeth 66 preventing movement in the opposite direction. FIG. 1*a* also shows a manifold 68 that is fed by a source of hydraulic pressure with takeoffs to each of the cylinders 16. In that manner if some of the pistons 18 stop moving because their location is adjacent the smaller radius for the surrounding tubular, the manifold pressure is maintained to allow other pistons in the assembly 18 to continue moving to create plastic deformation in the manner illustrated in FIG. 6 so that select portions of the seal assembly 48 can be moved out radially further than other portions. The use of the shape 44 also makes the axial length of the assembly short while providing support for the main seal 48 on opposed sides. It makes plastic deformation achievable with a lower piston force.

The piston assembly can be replaced by a single piston concentric with the mandrel with an intermediate piece between the piston and seal assembly that is designed to compress to varying degrees at key locations about the circumference as the seal assembly advances up the ramp surface 50 in order to distort into the shape shown in FIG. 6.

Alternatively the ramp 50 could be axially displaced toward the seal assembly 48 while the seal assembly is supported in the axial direction by the intermediate piece described above allowing the seal assembly to reach the final distorted shape shown in FIG. 6.

Although 20 piston assemblies 18 are described there can be other numbers of assemblies 18 depending on the size of the packer in question. The packer can have other components such as slips that are not illustrated as such features are known in the art. It should be noted that using a 3 degree ramp angle for ramp 50 and a tubular that is out of round by 0.070 inches meaning that the diameter difference in the tight and loose locations differ by 0.070 inches the loose side portion of the seal has to travel 0.67 inches further on ramp 50.

Figure 7:
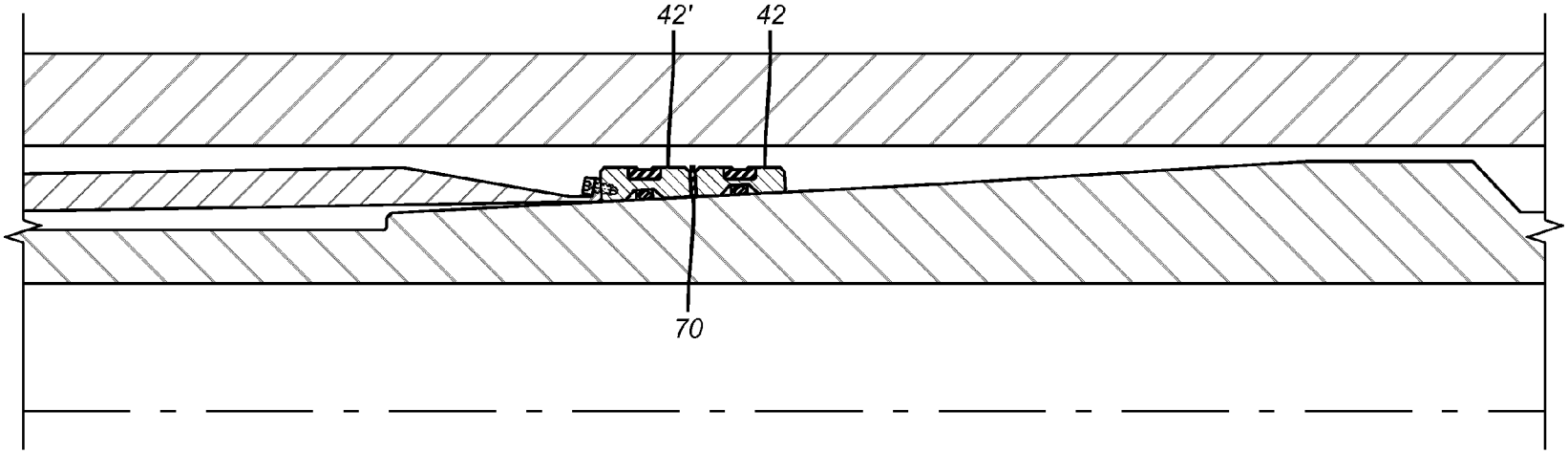
FIG. 7 is an alternative embodiment to FIG. 5.

FIG. 7 illustrates axial stacking of seal assemblies 42 and 42' for the added protection of a backup and yet a design with less bending resistance in the circumferential direction than a unitary body of equivalent axial length so that plastic deformation can still take place with a reasonably available force from the piston assemblies 18. A resilient ring 70 can be placed between the assemblies or adjacent the fastener 40 to add flexibility to the assembly when attempting to deform the stacked assemblies 42 and 42'. While taller stacks can be possible there is a need to consider the heightened force required for plastic deformation.

Figure 3:
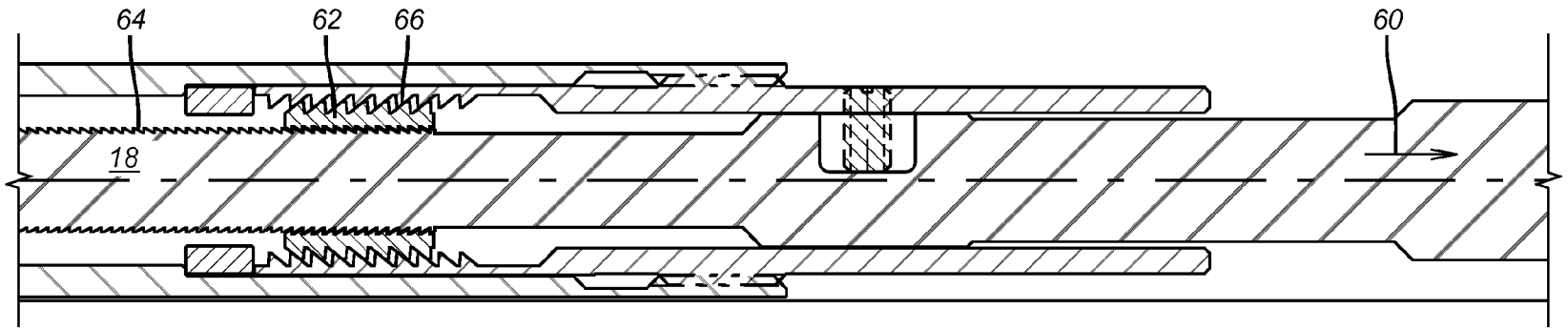
FIG. 3 is a section view of the ratchet lock shown in FIG. 1*a;*

The locking mechanism in FIG. 3 can also be optionally provided in another way or simply left off depending on the differential pressures anticipated. The plastic deformation of the assembly 42 along with slips on the packer that are not shown can be sufficient to hold the required seal even in an out of round tubular. These packer slips may be small carbide pieces fixed to the outer surface of the seal assembly. Alternatively the FIG. 3 locking mechanism can be defeated by undermining the illustrated mechanism such as by repositioning a support sleeve that supports the ratchet locked position with an applied axial pullout force to the mandrel 10. While the shape 44 is illustrated as a solid ring it can alternatively be a c-ring with abutting ends or a scroll with overlapping ends. A retraction spring like a garter spring can be used to collapse the shape 44 by moving it axially down the ramp surface 50 as the lock of FIG. 3 is overcome, if present, or simply with axially applied mandrel force if the FIG. 3 lock is not there.

Figure 8:
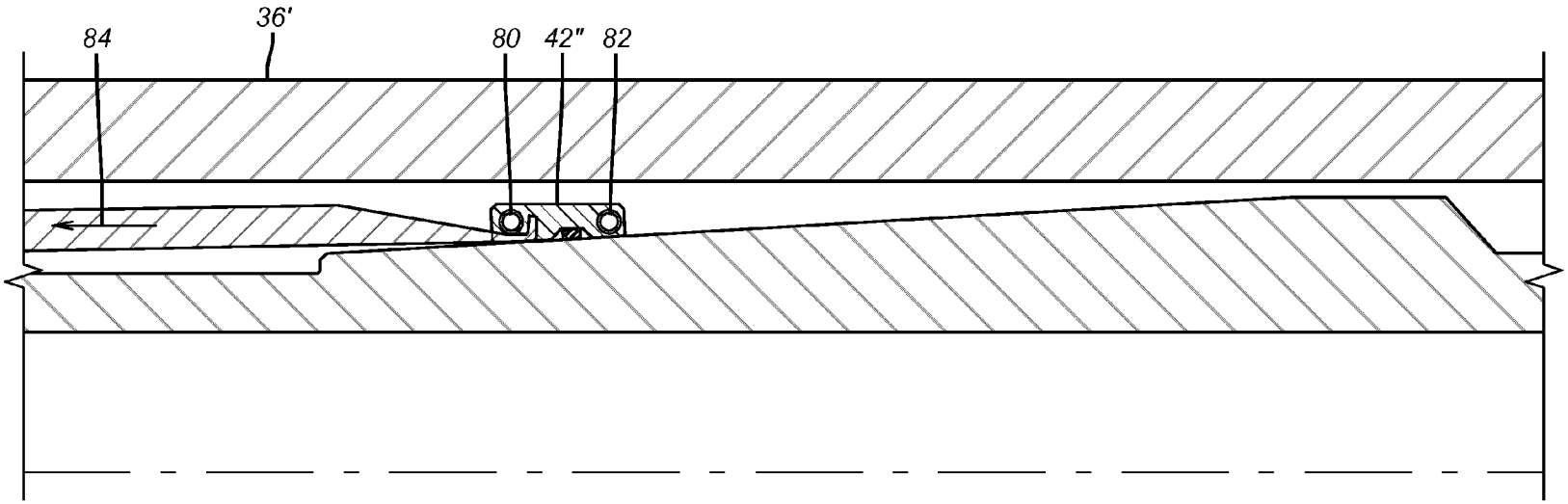
FIG. 8 illustrates a section view of a retrievable design for the seal assembly.

Another variation for a retrievable design is seen in FIG. 8 where the seal 42" is made from a resilient material rather than being carried with shape 44. In this instance the lower end of 36' is preferably embedded in seal 42" and there are further garter springs 80 and 82 that radially retract the seal 42" when 36' is urged to move in the direction of arrow 84. This can be done by a second manifold that is not shown on the opposite end from manifold 68 to push the piston assembly 18 in the direction of arrow 84. In this instance the deformation to set is elastic as the rubber or other resilient material is flexible and specified to handle the expected temperatures, pressures and exposure anticipated in the borehole.

The above description is illustrative of the preferred embodiment and many modifications may be made by those skilled in the art without departing from the invention whose scope is to be determined from the literal and equivalent scope of the claims below:

We claim:

1. A seal assembly and setting mechanism for selective sealing contact with an out of round surrounding tubular wall at a subterranean location, comprising:

a ramp supported by a mandrel;

a compliant force applier mounted to said mandrel;

a seal assembly positioned circumferentially around said ramp and operably connected to said compliant force applier for uneven longitudinal displacement of said seal assembly around the circumference thereof and with respect to said ramp.

2. The assembly of claim 1, wherein:

said compliant force applier comprises a plurality of pistons mounted to said mandrel and circumferentially spaced from each other.

3. The assembly of claim 2, wherein:

said pistons comprise rod pistons with an end engaging said seal assembly.

4. The assembly of claim 2, wherein:

said pistons comprise rod pistons with an end secured to said seal assembly with a fastener.

5. The assembly of claim 2, wherein:

said pistons comprise rod pistons with an end embedded in said seal assembly.

6. The assembly of claim 2, wherein:

said pistons comprise a lock to hold the position of said pistons against movement in opposed directions.

7. The assembly of claim 6, wherein:

said lock is defeated with a force applied to said pistons.

8. The assembly of claim 6, wherein:

said pistons are connected with at least one manifold for common delivery of hydraulic pressure to move said pistons in at least a first direction with respect to said ramp.

9. The assembly of claim 2, wherein:

said pistons each comprise a pinned lower end segment to facilitate pivoting movement of said lower end segments as said pistons move with respect to said ramp.

10. The assembly of claim 9, wherein:

said lower end segments further comprise a taper leading to a lower end fastener attached to said seal assembly, said taper allowing placement of said fastener in a recessed location that does not protrude radially beyond said lower end segments.

11. The assembly of claim 1, wherein:

said seal assembly is plastically deformed.

12. The assembly of claim 1, wherein:

said seal assembly is elastically deformed.

13. The assembly of claim 1, wherein:

said compliant force applier comprises a plurality of pistons mounted to said mandrel and circumferentially spaced from each other;

said seal assembly is formed of a resilient material with at least one embedded spring.

14. The assembly of claim 13, wherein:

said pistons have ends embedded in said resilient material.

15. The assembly of claim 1, wherein:

said seal assembly comprises at least one grooved ring with a sealing element in said groove.

16. The assembly of claim 15, wherein:

said ring is continuous.

17. The assembly of claim 15, wherein:

said ring has abutting or overlapping ends.

18. The assembly of claim 15, wherein:

said seal assembly further comprises a resilient ring adjacent said grooved ring.

19. The assembly of claim 15, wherein:

said compliant force applier comprises a plurality of pistons mounted to said mandrel and circumferentially spaced from each other;

said grooved ring comprising at least one groove is plastically deformed in an axial direction due to out of roundness of a surrounding tubular allowing one of said pistons to travel more than another of said pistons.

20. The assembly of claim 19, wherein:

said plastic deformation brings a portion of said groove of said grooved ring and sealing element therein axially and radially further than other portions of said grooved ring with respect to said ramp.

21. The assembly of claim 15, wherein:

said seal assembly comprises a plurality of adjacent grooved rings each with an its associated resilient ring for conformance of the seal assembly to the out of round tubular by allowing for relative sliding between each grooved ring when compared to a single grooved ring of equivalent axial length.

* * * * *